United States Patent [19]

Traeger et al.

[11] Patent Number: 4,989,521

[45] Date of Patent: Feb. 5, 1991

[54] GRAVITY FED PELLET BURNER

[76] Inventors: Joseph P. Traeger, 250 S. Oak St.; Mark A. Traeger, 530 Alder St.; Randolph J. Traeger, 540 Leo St., all of Mt. Angel, Oreg. 97362

[21] Appl. No.: 505,590

[22] Filed: Apr. 6, 1990

[51] Int. Cl.[5] ..... F23K 3/10; F23K 3/16

[52] U.S. Cl. ..... 110/108; 110/102; 110/116; 110/117; 110/118

[58] Field of Search ..... 110/102, 108, 116, 117, 110/118

[56] References Cited

U.S. PATENT DOCUMENTS

| | | | |
|---|---|---|---|
| 38,744 | 6/1863 | Hopkins . | |
| 201,086 | 3/1878 | Barnes . | |
| 1,994,423 | 3/1935 | Ure . | |
| 2,229,555 | 1/1941 | Dartnell . | |
| 4,253,407 | 3/1981 | Larson . | |
| 4,325,310 | 4/1982 | Babbage | 110/108 X |
| 4,543,890 | 10/1985 | Johnson . | |
| 4,545,309 | 10/1985 | Comtois | 110/117 X |
| 4,559,882 | 12/1985 | Dobson . | |
| 4,782,767 | 11/1988 | Stoner . | |

FOREIGN PATENT DOCUMENTS

| | | | |
|---|---|---|---|
| 0187524 | 11/1982 | Japan | 110/116 |
| 66681 | 9/1913 | Switzerland | 110/108 |

*Primary Examiner*—Edward G. Favors

*Attorney, Agent, or Firm*—Kolisch, Hartwell, Dickinson, McCormack & Heuser

[57] ABSTRACT

A gravity operated burner for particulate fuel. Fuel held in a hopper drops downwardly through a fuel tube to fall on an inclined chute. The chute feeds a shelf where burning takes place in a high heat zone. Material on the shelf stops unhindered flow of fuel down the chute.

5 Claims, 2 Drawing Sheets

FIG. 2
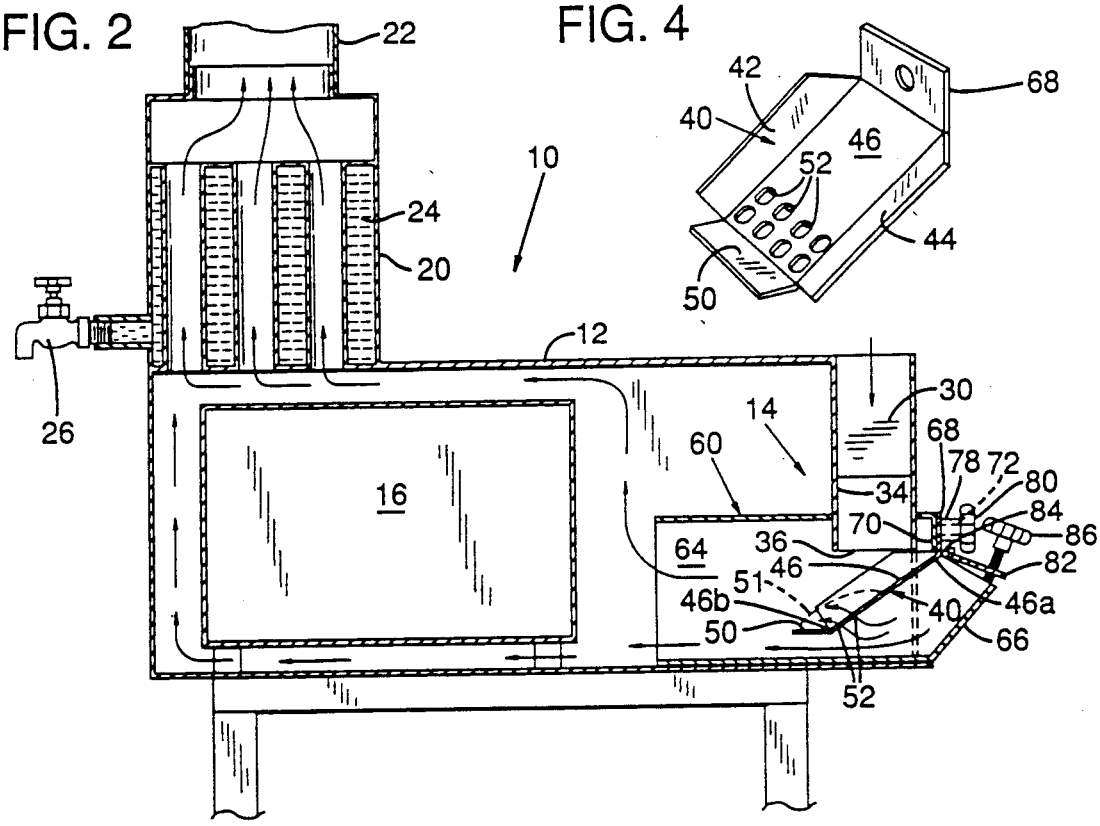
FIG. 4
FIG. 3
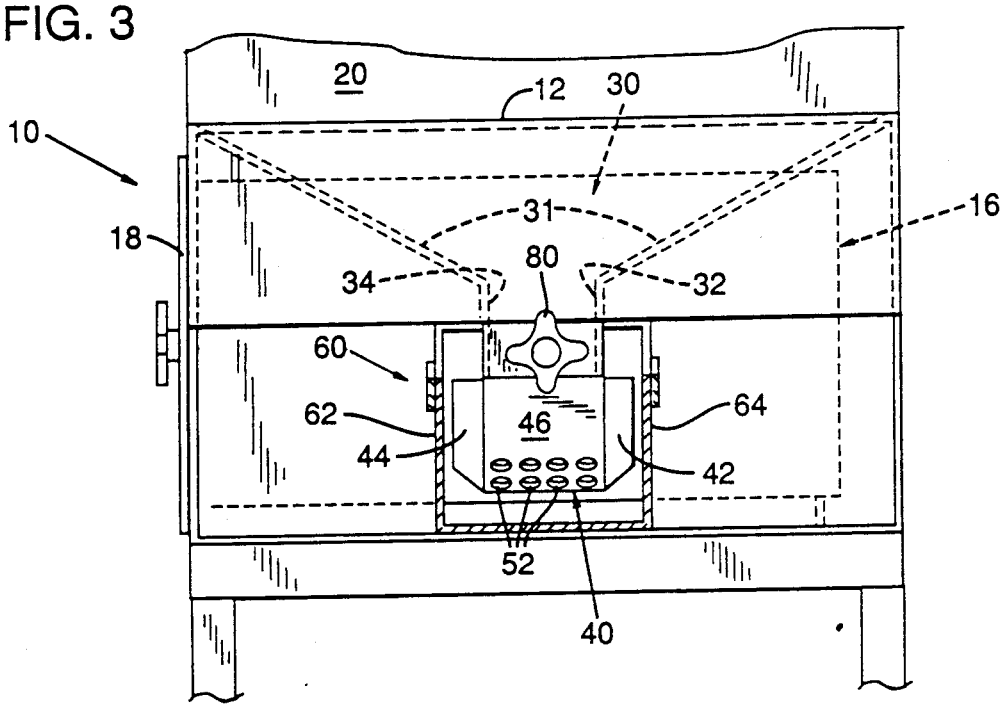

GRAVITY FED PELLET BURNER

This invention relates to a burner for combusting a particulate fuel, as exemplified by wood pellets, chopped poplar pieces, dried corn, crushed nut shells, etc. The burner contemplated is a very efficient burner, utilizing a localized high heat zone where combustion occurs. With there being substantially complete combustion of the fuel used, harmful smoke emissions are maintained at a minimum. The fuel may be gravity fed, making the burner particularly useful where electrical power is not available.

A general object of the invention, therefore, is to provide a new and improved burner which combusts particulate fuel such as pellets, cracked nut shells, etc.

More particularly, an object is to provide such a burner where the fuel is gravity fed, with combustion occurring at a concentrated high heat zone in the burner.

The burner contemplated is safe and efficient. With a sufficient amount of fuel stored in a hopper which provides fuel for the burner, combustion takes place over a relatively long period of time, without any supervision required, such as characterizes the operation of a wood stove or other fuel burner.

Initial lighting up of the fuel to start the burner is performed relatively easily.

These and other objects and advantages are attained by the invention, which is described hereinbelow in conjunction with the accompanying drawings, wherein:

FIG. 2 is a longitudinal cross-sectional view of the stove;

FIG. 3 is a cross-sectional view, taken generally along the line 3—3 in FIG. 2; and FIG. 4 is a perspective view illustrating a chute and shelf unit forming part of the burner.

Figure 1:
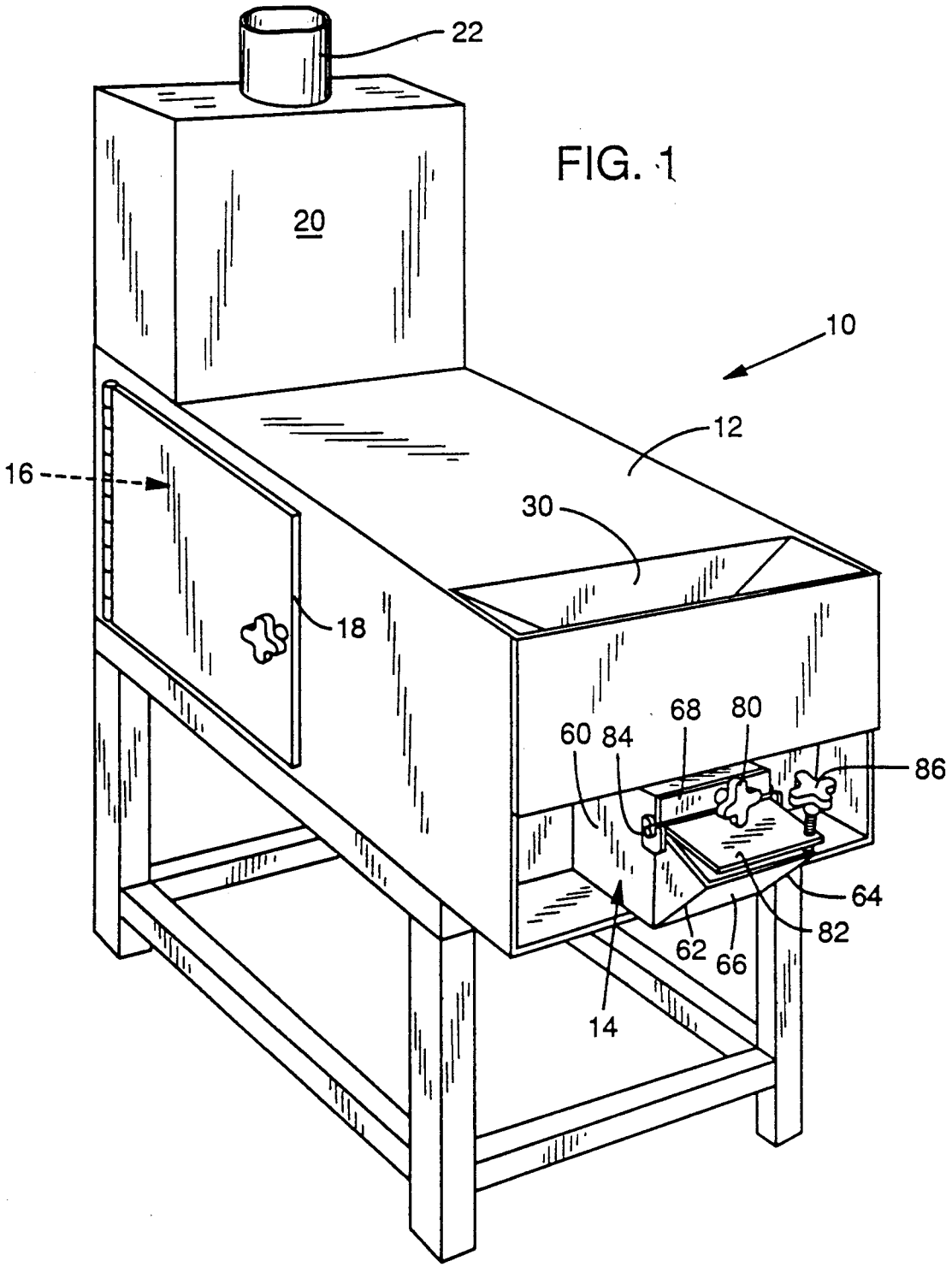
FIG. 1 is a perspective view of a stove outfitted with the burner contemplated.

Referring now to the drawings, the burner of the invention is shown incorporated with a small stove 10, such as might be utilized by outdoorsmen, hunters, or fishermen to provide heat and cooking capability where electric power is not available. Stove 10 includes a metallic, substantially rectangular box 12 which at one end houses a burner generally shown at 14. Formed at the other end of the box is an oven 16 closed by a door 18. Hot gases and products of combustion exit the burner 14 to flow over the outside of oven 16 thus to heat it, thence pass over a heat exchanger provided in an enclosure 20 finally to be discharged to the atmosphere through a stack 22. The heat exchanger heats water which is withdrawn from the exchanger through a faucet 26.

Considering now in more detail the construction of the burner, such includes a hopper 30 which is located adjacent the top of the burner. The hopper includes downwardly inclining opposed sides 31 converging on each other progressing to the base of the hopper.

Communicating with the interior of the hopper at the base of the hopper, through an opening 32 at the base, is a fuel tube 34. The tube has an opening 36 at its base. The tube provides for the controlled flow of particulate fuel, i.e., pellets, from the base of the hopper and downwardly through opening 36. During operation of the burner, a column of fuel forms in the tube which gradually falls downwardly and replenishes as needed the fuel which is being burned, as will be described herein.

Supported below the bottom of fuel tube 34 is an inclined channel-shaped chute 40. The chute has opposed upstanding side flanges 42, 44 (see FIG. 4) which are outwardly of opposite sides of the fuel tube, and which operate to confine fuel as such slides down the chute. Inclined base 46 of the chute progresses from an upper end **46*a* located on one side of the fuel tube to an opposite lower end 46*b* located well beyond the opposite left side of the fuel tube, as shown in FIG. 2**. In extending across the base of the fuel tube, the chute offers impairment to the free flow of pellet fuel from out of the hopper.

Formed as an integral part of the chute and extending substantially horizontally from the lower end of the chute is what is referred to herein as a shelf 50. Fuel flowing down the chute gathers on the shelf to collect as a pile. This is indicated in FIG. 2 by the dashed line 51, which shows the repose of typical fuel before ignition of the fuel. With the fuel unignited, the fuel that collects on the shelf stops further flow of fuel down the chute and also down the tube into the chute so that fuel flow is stopped.

The chute base 46 has holes or perforations 52 extending there through adjacent the lower end of the chute. This provides for the flow of combustion-supporting air into the mass of fuel that collects on the shelf.

Shown at 60 is what is referred to herein as a burner tube. Such may be a tube of a substantially square cross-section, and typically has a side-to-side dimension which is approximately twice the diameter of the fuel tube. Thus, with a fuel tube of two inch diameter, a burner tube of from three to five inches from side-to-side might be employed. The burner tube extends about and thus houses the chute, the shelf, and the bottom of the fuel tube.

At the right of the burner tube wing extensions 62, 64 of the tube side walls, and inclined wall 66, which is a continuation of the base of the burner tube, cooperate to define an open throat through which air passes from the atmosphere downwardly into the burner tube. The opposite end of the tube is open, which provides for the exhaust of combustion materials through the opposite end of the tube. The burner tube has an interior which is spaced outwardly from the chute and shelf, whereby an air flow passage is provided around the chute to supply combustion-supporting air to material located on the shelf.

The chute and its joined shelf are mounted in place in a detachable manner. Specifically, the chute and shelf unit is provided with a mounting tab 68 at the upper end of the chute. Suitably secured to a downwardly projecting lip 70 of the burner tube is a threaded shank 72. This shank passes through an accommodating bore provided in tab 68. An internally threaded hub 78 is screwed onto shank 72. Knob 80 joined to the hub enables hand turning of the hub when desired.

By providing hub or screw fastener 78 and the detachable mounting of chute 40, it is a relatively easy matter to remove the chute and shelf, when desired, as for cleaning purposes.

A cover plate 82 mounted by a detachable hinge means 84 on the frame of tube 60 is adjustable to vary the degree of opening of the throat defined by side walls 62, 64. Hand screw 86 is turned to produce adjustment in the position of the plate 82.

Describing the operation of the burner, pellet fuel is loaded into the hopper and such flows from the hopper down through the fuel tube onto the inclined chute, thence to flow onto the shelf, with the building up of a small mass on the shelf. The angle of repose of the fuel maintains this mass on the shelf, and this mass in turn causes fuel to back up the chute and into the fuel tube with a stable condition reached.

The burner is easily lit by crumpling up paper and passing such down through the throat described to place such under and against the shelf. With the fuel ignited, a draft is created causing air to pass inwardly through the throat about the chute and onto the burning mass of material. Some air passes through openings 36 described.

The chute keeps the fuel away from the side walls of the burner tube. The shelf at the base of the chute holds the fuel adjacent the base of the burner tube, but spaced upwardly from it with air flow thus permitted under the shelf. As fuel is consumed, ashes collect and fall off the shelf and pellet fuel through gravity flows down the chute to replace the fuel consumed. The holes in the base of the chute adjacent its lower end promote combustion efficiency by introducing air directly into the burning pile. The introduction of this air also tends to cause the fuel to burn or ignite while on the shelf, rather than at an upper region of the chute.

Combustion occurs at a relatively concentrated zone, which is the region where the fuel is supported on the shelf. Combustion is at a relatively hot temperature, and thus efficient, by reason of the amount of air which is permitted to support the combustion. With the actual amount of fuel which is ignited at any time being relatively small, the rate of consumption of the fuel is not large, and as a result, a hopper of relatively modest sized is sufficient to enable the burner to continue in operation for several hours.

No tendency has been observed for the fuel to back burn up the chute. Inclined wall 66 and extensions 62, 64 define a throat for the inlet of combustion-supporting air, but the construction is such as to keep sparks and embers from falling out of the burner to create a more hazardous situation.

While a particular embodiment of the invention has been described, obviously, modifications and variations are possible without departing from the invention.

It is claimed and desired to secure by Letters Patent:

1. A gravity operated burner for particulate fuel comprising:

an upright hopper for holding the fuel, a constricted opening at the base of the hopper providing for controlled flow of fuel from the hopper, a chute spaced downwardly from said opening having an upper end disposed laterally outwardly of one side of said opening and inclining downwardly from this upper end to a lower end disposed laterally outwardly to the opposite side of said opening, and a substantially horizontal shelf adjacent and extending outwardly of the lower end of the chute providing a region where burning of fuel takes place, the burner further including a burner tube which houses the chute and the self and the burner tube having an interior spaced outwardly from the chute and self whereby an airflow passage is defined to support combustion of the fuel deposit on the shelf, the chute and shelf being joined and forming an integral unit and there being means detachably mounting the chute and shelf unit on the burner tube.

2. The burner of claim 1, wherein the chute and shelf unit includes a mounting tab adjacent the upper end of the chute, and the means detachably mounting the chute and shelf unit includes screw means operating on said tab exposed on the outside of one end of the burner tube.

3. A gravity operated burner for particulate fuel comprising:

an upright hopper for holding the fuel, an upright fuel tube joining with the base of the hopper and extending downwardly from the hopper, said tube defining a constricted opening producing controlled flow of fuel from the hopper and through the tube, a chute and shelf unit which includes a chute having an upper end located on one side of the tube and adjacent the tube's bottom end and inclining downwardly to a lower end for the chute which is disposed beyond the opposite side of the tube, the chute defining a flow path for fuel flowing from the tube, the chute and shelf unit further including a substantially horizontal shelf joining with the base of the chute that collects fuel flowing down the chute, the shelf with the fuel unignited capturing the fuel and forming a back-up which is effective to stop flow of fuel through the opening and downwardly on the chute, the burner further including a burner tube which encloses the base of the fuel tube and said chute and shelf unit, the burner tube having an interior which is spaced outwardly from the chute and shelf unit whereby the passage for the flow of air is provided which supports combustion occurring in the burner tube, the chute and shelf unit including a mounting tab provided at the upper end of the chute and there being mounting means detachably mounting the unit on the burner tube through said tab.

4. The burner of claim 3, wherein said means mounting comprises a screw fastener means which is exposed beyond one end of the burner tube.

5. A gravity operated burner for particulate fuel comprising:

an upright hopper for holding the fuel, a constricted opening at the base of the hopper providing for controlled flow of fuel from the hopper, a chute and shelf unit which includes a chute having an upper end located adjacent one side of said opening and inclining downwardly from this upper end to a lower end disposed laterally outwardly to the opposite side of the opening, the chute defining a flow path for fuel flowing from the opening, the chute and shelf unit further including a substantially horizontal shelf joining with the base of the chute that collects fuel flowing down the chute, the shelf with the fuel unignited catching the fuel and forming a backup which is effected to stop flow of fuel through the opening and downwardly on the chute, the chute and shelf unit being joined and forming an integral unit, and means detachably connecting with the upper end of the chute providing for the detachable mounting of the chute and shelf unit in the burner.

* * * * *